US006901704B2

(12) United States Patent
Sakaue et al.

(10) Patent No.: US 6,901,704 B2
(45) Date of Patent: Jun. 7, 2005

(54) VEHICLE REAR GATE OPENING AND CLOSING APPARATUS

(75) Inventors: Hirofumi Sakaue, Tokyo (JP); Kenji Okada, Tokyo (JP); Nobuzi Suzuki, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 15 days.

(21) Appl. No.: 09/752,564

(22) Filed: Jan. 3, 2001

(65) Prior Publication Data

US 2001/0008057 A1 Jul. 19, 2001

(30) Foreign Application Priority Data

Jan. 14, 2000 (JP) ..... P. 2000-006856
Jan. 14, 2000 (JP) ..... P. 2000-007040

(51) Int. Cl.[7] ..... E05F 15/02
(52) U.S. Cl. ..... 49/340; 296/56
(58) Field of Search ..... 49/338, 339, 340, 49/348, 349, 341; 296/56, 146.8

(56) References Cited

U.S. PATENT DOCUMENTS 5,531,498 A 7/1996 Kowall
5,563,483 A * 10/1996 Kowall et al. ..... 318/283
5,588,258 A * 12/1996 Wright et al. ..... 49/340
5,757,156 A 5/1998 Sasajima
5,982,126 A * 11/1999 Hellinga et al. ..... 318/468
5,986,420 A * 11/1999 Kato ..... 318/272
6,055,775 A * 5/2000 Dering et al. ..... 49/340
6,055,776 A * 5/2000 Dettling et al. ..... 49/341
6,137,249 A * 10/2000 Butler et al. ..... 318/266
6,142,551 A * 11/2000 Ciavaglia et al. ..... 296/56
6,174,015 B1 * 1/2001 Shave ..... 296/56
6,283,535 B1 * 9/2001 Yuge ..... 296/146.8
6,298,604 B1 * 10/2001 Rogers et al. ..... 49/340
6,387,392 B1 * 5/2002 Saito et al. ..... 424/435
6,398,288 B1 * 6/2002 Yuge ..... 296/146.4

FOREIGN PATENT DOCUMENTS

| | | |
|---|---|---|
| DE | 41 24 869 | 1/1993 |
| GB | 954592 | 4/1964 |
| JP | 75-280242 | 10/1993 |

OTHER PUBLICATIONS

European Search Report relating to corresponding European Application No. EP 01 30 0319 dated Jun. 19, 2001.

* cited by examiner

*Primary Examiner*—Gregory J. Strimbu
(74) *Attorney, Agent, or Firm*—Smith, Gambrell & Russell

(57) ABSTRACT

A rear gate opening and closing apparatus includes a gas stay for biasing a rear gate in an opening direction, a motor for actuating to open or close the rear gate, a clutch for connecting or disconnecting the motor with the rear gate, an encoder for detecting the position of the rear gate, an operating switch for operating an opening and closing motion of the rear gate, and a control means for controlling the motor and clutch to automatically open and close the rear gate. The opening and closing speed of the rear gate is controlled based on a detection signal of the encoder.

14 Claims, 11 Drawing Sheets

VEHICLE REAR GATE OPENING AND CLOSING APPARATUS

BACKGROUND OF THE INVENTION

1. Field of the Invention

The present invention relates to a vehicular rear gate opening and closing apparatus whose upper end is pivotally connected with a vehicle body so as to swing up and down and more particularly to a rear gate capable of opening and closing in two ways by an actuator or by hand.

2. Discussion of Prior Art

As shown in FIG. 11, generally a rear gate 102 disposed in the rear of a vehicle is a lid swinging up and down for opening and closing an opening 101. The rear gate 102 is at the upper end thereof secured to a hinge arm 103 rotatably supported by an upper edge of the opening 101 of a vehicle body 100.

A gas stay 105 is connected between a side edge of the rear gate 102 and a side edge 104*a* of the opening 101 formed along a rear pillar 104. The gas stay 105 has a piston rod 105*a* biased in an axial (longitudinal) direction by sealed gas pressure. When the rear gate 102 opens or closes, the gas stay 105 expands or contracts according to an opening or closing angle of the rear gate 102 and the biasing force applies an assist force to the piston rod 105*a*, thereby an opening or closing effort of the rear gate 102 can be reduced.

According to a rear gate opening and closing mechanism disclosed in Japanese Patent Application Laid-open No. Toku-Kai-Hei 5-280242 and also shown in FIG. 12, the rear gate 112 has a hinge arm 113 at the upper end thereof and the hinge arm 113 is pivotally supported by a vehicle body 110. The hinge arm 113 has a curved section 114 formed in such a manner as extending forwardly from a pivoting point P of the hinge arm 113, making a U-turn and then extending backwardly. The curved section 114 communicates with a rear gate fitting section 115 to which the rear gate 112 is secured. A rod 116 is pivotally connected at a boss section 117 provided at the rear end thereof with a slightly lower part of the curved section 114 than the pivoting point P. A front end of the rod 116 is slidably fitted to a supporting hole 118 and a coil spring 119 is interposed between a rear spacer 120 and the boss section 117.

According to the rear gate structure shown in FIG. 11, the gas stay 105 laid between the rear gate 102 and the side edge 104*a* provides an assist force when the rear gate 102 operates to open or closed and as a result the operating effort of the rear gate 102 can be reduced.

Referring to FIG. 12, when the rear gate 112 is wings upward, the hinge arm 113 rotates integrally with the rear gate 112 around the pivoting point P. Then, since the coil spring 119 pushes the curved section 114, a rotating force is applied to the hinge arm 113, thereby the operating effort when opening the rear gate 112 can be reduced.

However, there is a fear that the gas stay 105 which is provided between the rear gate 102 and the side edge 104*a* hinders loading or unloading works through the opening 101. Further, since the gas stay 105 is exposed to the compartment, there is a problem that the interior space is limited as much and also there is an aethetic problem. To solve these problems, one idea is to accommodate the gas stay between the rear gate 102 and the side edge 104*a* of the opening 101. Since the diameter of the gas stay is determined by gas pressure for supporting the weight of the rear gate, the thickness of the pillar in which the gas stay is housed is dependant upon the rear gate. Further, since the stroke of the gas stay is determined by the specification of the rear gate, the straight portion of the rear pillar for accommodating the gas stay has an effect on the styling of the rear pillar itself. That is, the freedom of the rear design of the vehicle is restricted.

According to the rear gate structure disclosed by Toku-Kai-Hei 5-280242, when the rear gate 112 swings upward to open, the curved section 114 of the hinge arm 113 is pushed by the coil spring 119. As a result, the hinge arm 113 has a rotating force to reduce the operating effort of an operator. Further, since the gas stay is not disposed between the side edge of the opening and the rear gate 112, the freedom of designing of the rear pillar, the rear gate 112 and the like is enlarged.

On the other hand, the rear gate structure according to Toku-Kai-Hei 5-280242 is designed so as to open and close by lifting up or pushing down an outer handle of the rear gate by hand from outside of the vehicle. The opening and closing effort of the rear gate is generally troublesome to the operator and particularly, when it rains heavily and his or her hands are full with baggage, it is desirable that an opening and closing apparatus for automatically opening and closing the rear gate can be operated by the operator while he or she stays in the passenger compartment.

SUMMARY OF THE INVENTION

It is a first object of the present invention to provide a compact rear gate opening and closing apparatus capable of automatically opening and closing a rear gate without hindering an interior space of the passenger compartment. It is a second object of the present invention to provide a rear gate opening and closing apparatus capable of opening and closing the rear gate not only automatically but also by hand. It is a third object of the present invention to provide a rear gate opening and closing apparatus capable of properly regulating the opening and closing speed.

In order to achieve the first object, the rear gate opening and closing apparatus comprises a power source means for producing a power to actuate the rear gate, a slider for transforming the power into a reciprocating motion and traveling in the longitudinal direction of a vehicle, a hinge arm provided at the upper end of the rear gate for pivotally connected with the vehicle body, a connecting rod for interlocking between the slider and the hinge arm and for transmitting the reciprocating motion to the hinge arm, a mounting base for supporting the power source means and the slider, a mounting base installing means for detachably installing the mounting base in a space formed by a rear rail, a side rail and an under roof of the vehicle, and a gas stay extending in the longitudinal direction of the vehicle, provided between the side rail and the hinge arm and disposed at approximately the same height as and in parallel with the connecting rod for biasing the rear gate in an opening direction.

To attain the second object of the present invention, The rear gate opening and closing apparatus comprise a clutch means for disconnecting the power source means with the slider so as to enable an operator to open or close the rear gate by hand.

Further, to attain the third object, the rear gate opening and closing apparatus comprises a position detecting means for detecting a position of the rear gate and for outputting a detection signal thereof, an operating means for operating an opening and closing motion of the rear gate and a control means for automatically opening and closing the rear gate based on an operating signal from the operating means and the detection signal from the position detecting means.

DESCRIPTION OF THE PREFERRED EMBODIMENTS

The present invention will be described more in detail by reference to the accompanying drawings.

Figure 1:
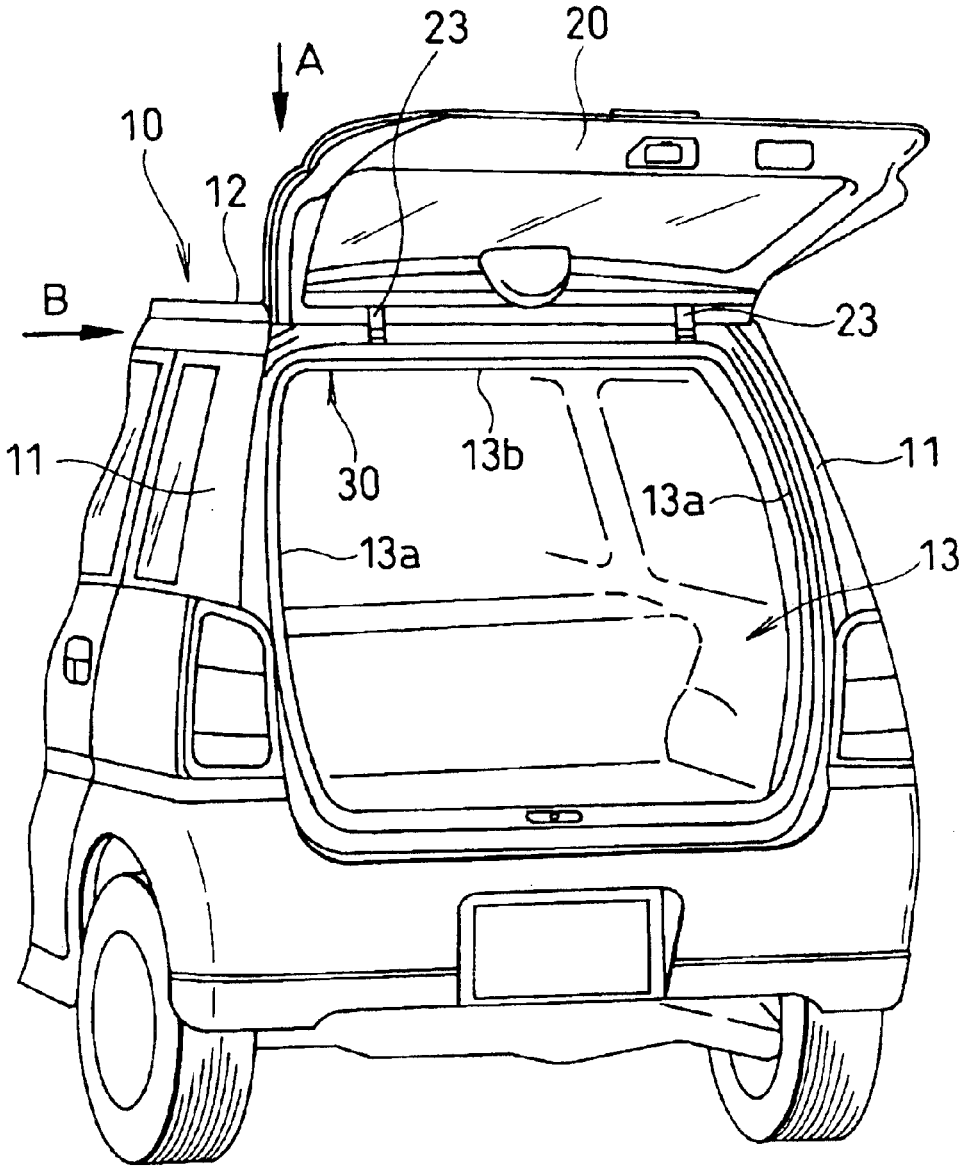
FIG. 1 is a perspective rear view showing a vehicle having a rear gate opening and closing apparatus according to the present invention.

Referring now to FIG. 1, a vehicle body 10 is provided with a rear opening 13 having a side edge 13*a* at each side of the body 10 and an upper edge 13*b*. A roof 12 is connected at the rear end thereof with a rear gate 20 for pivotally opening and closing the opening 13 through a hinge arm 23. The rear gate 20 is rotatably swung up and down by an opening and closing apparatus 30.

The opening and closing apparatus 30, especially the hinge arm 23 and the drive unit 31, will be described by reference to FIGS. 2 to 7. In the drawings, an arrow-marked "F" denotes a front direction of the vehicle, an arrow-marked "IN" denotes an inner direction of the vehicle and an arrow-marked "OUT" denotes an outer direction of the vehicle.

Figure 2:
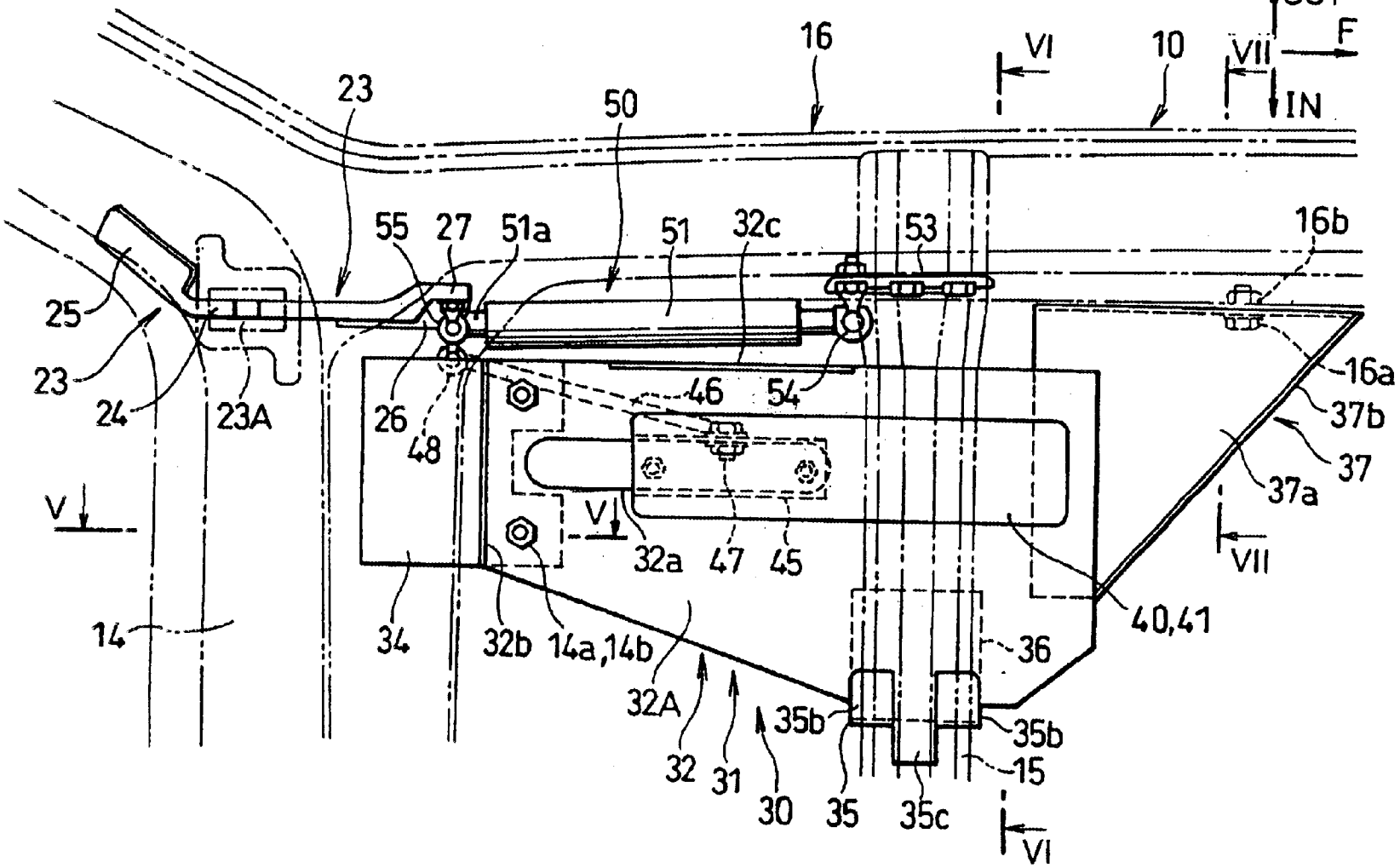
FIG. 2 is a plan view showing a drive unit of a rear gate opening and closing mechanism according to a first embodiment of the present invention.
Figure 3:
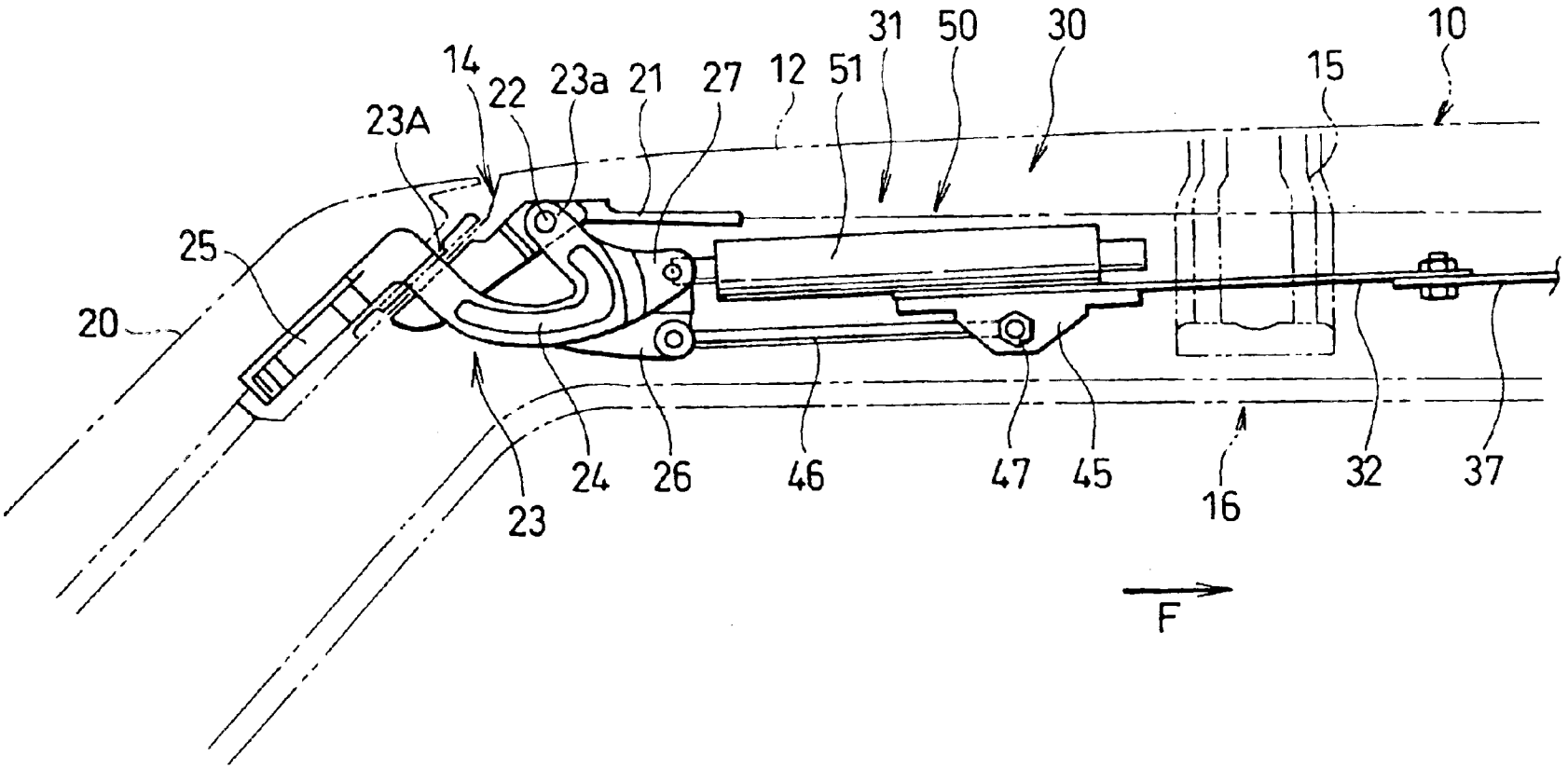
FIG. 3 is a side view showing a drive unit of a rear gate opening and closing mechanism according to the present invention.

FIG. 2 shows a drive unit of a rear gate opening and closing mechanism according to a first embodiment of the present invention and FIG. 3 shows a drive unit of the rear gate opening and closing mechanism. In FIGS. 2 and 3, the vehicle body 10 and the rear gate 20 are shown by two-dots chain lines.

The hinge arm 23 is rotatably supported at the end boss 23*a* thereof by a pivot 22 secured to an hinge base 21 which is attached to the neighborhood of the rear end of a roof 12. Describing the state where the rear gate 20 is closed, the hinge arm 23 extending downwardly and forwardly from the end boss 23*a*, forms a bent section 24. The bent section 24 extends backwardly being bent in a circle around the pivot 22, penetrates through a hinge arm penetrating hole 23A provided in a rear rail 14 and projects the rear end thereof outside. The rear end has a rear gate mounting bracket 25 for mounting the rear gate 20 and the front end of the bent section 24 has a connecting rod connection section 26 and a gas stay connection section 27.

Figure 4:
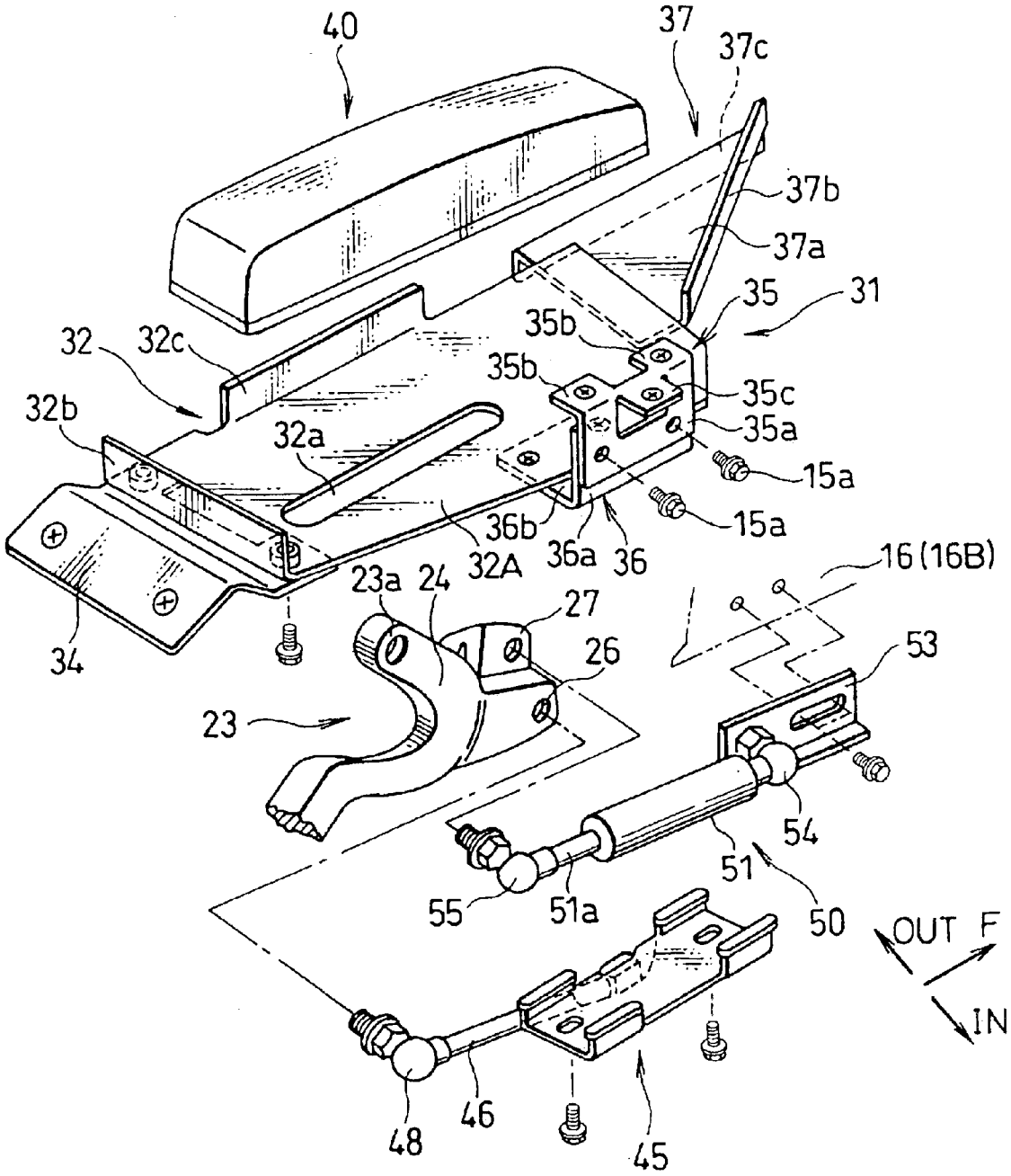
FIG. 4 is an exploded view of a drive unit of a rear gate opening and closing apparatus according to the present invention.

The opening and closing apparatus 30 has the drive unit 31 and a gas stay apparatus 50 for assisting the operation of the drive unit 31. As shown in FIGS. 2 and 4, the drive unit 31 is provided with a mounting base 32 having a base plate 32A with a slot 32*a* longitudinally spaced, a rear flange 32*b* and a side flange 32*c* for reinforcing the base plate 32A.

Further, a power unit module 40 as shown in FIG. 4 is mounted on the top surface of the base plate 32A of the mounting base 32.

The power unit module 40 includes a motor 41 operative forwardly and reversely and a gear box (not shown) for converting the rotating motion of the motor into the reciprocating motion, through which a slider 45 disposed under the base plate 32A is reciprocatingly moved in the longitudinal direction along the slot 32*a*.

The slider 45 is roughly rectangular in configuration and has a U-shaped cross section. The slider 45 is rotatably connected at the side face thereof with a connecting rod 46 by a bolt and nut 47. Further, the connecting rod 46 is rotatably connected at the rear end thereof with the connecting rod connection section 26 of the hinge arm 23 through a ball joint 48.

When the motor 41 in the power unit module 40 operates, the slider 45 travels backwardly along the base plate 32A to push backwardly the connecting rod connection section 26 of the hinge arm 23 through the connecting rod 46 and as a result the hinge arm 23 rotates around the pivot 22 outwardly through the hinge arm penetrating hole 23A. As a result, the rear gate 20 supported by the rear gate mounting bracket 25 swings in a direction of opening the opening 13. On the other hand, when the slider 45 travels forwardly along the base plate 32A, the hinge arm 23 rotates around the pivot 22 inwardly to swing the rear gate 20 in a direction closing the opening 13.

The mounting base 32 on which the power unit module 40, the slider 45 and the like are disposed, is secured to roof members, rear rail 14, brace 15 and side rail 16, respectively so as to hold the base plate 32A horizontally.

Figure 5:
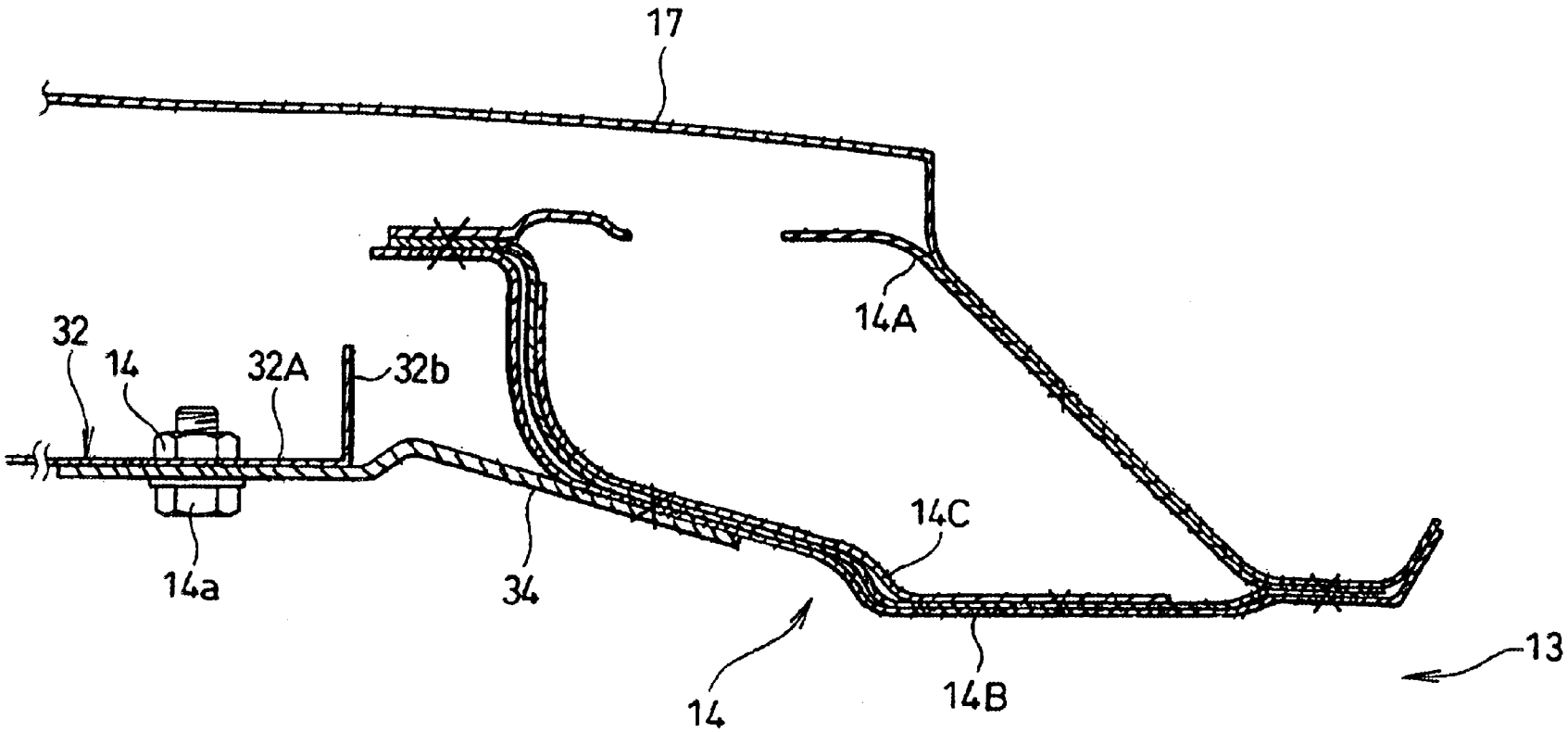
FIG. 5 is a sectional view taken along a line V—V of FIG. 2.

The connecting section of the mounting base 32 and the rear rail 14 will be described by reference to FIG. 5 showing a cross section taken by the line I—I.

The rear rail 14 has a hollow cross section formed by an outer rear rail 14A extending in the widthwise direction of the vehicle and having a L-shaped cross section and an inner rear rail 14B disposed opposite to the outer rear rail 14A. The inner rear rail 14B is reinforced by a reinforcement 14C covering the upper surface of the inner rear rail 14B. The rear rail 14 is connected at left and right ends thereof with the rear end of left and right side rails 16 and is connected at the upper surface of the outer rear rail 14A with the rear end of a roof panel 17, respectively.

Further, a plate-shaped rear bracket 34 is spot-welded to the under surface of the inner rear rail 14B, extending therefrom forwardly. The rear section of the base plate 32A of the mounting base 32 is mounted on the upper surface of the front end of the rear bracket 34 and detachably connected by a bolt 14*a* and a nut 14*b*.

Figure 6:
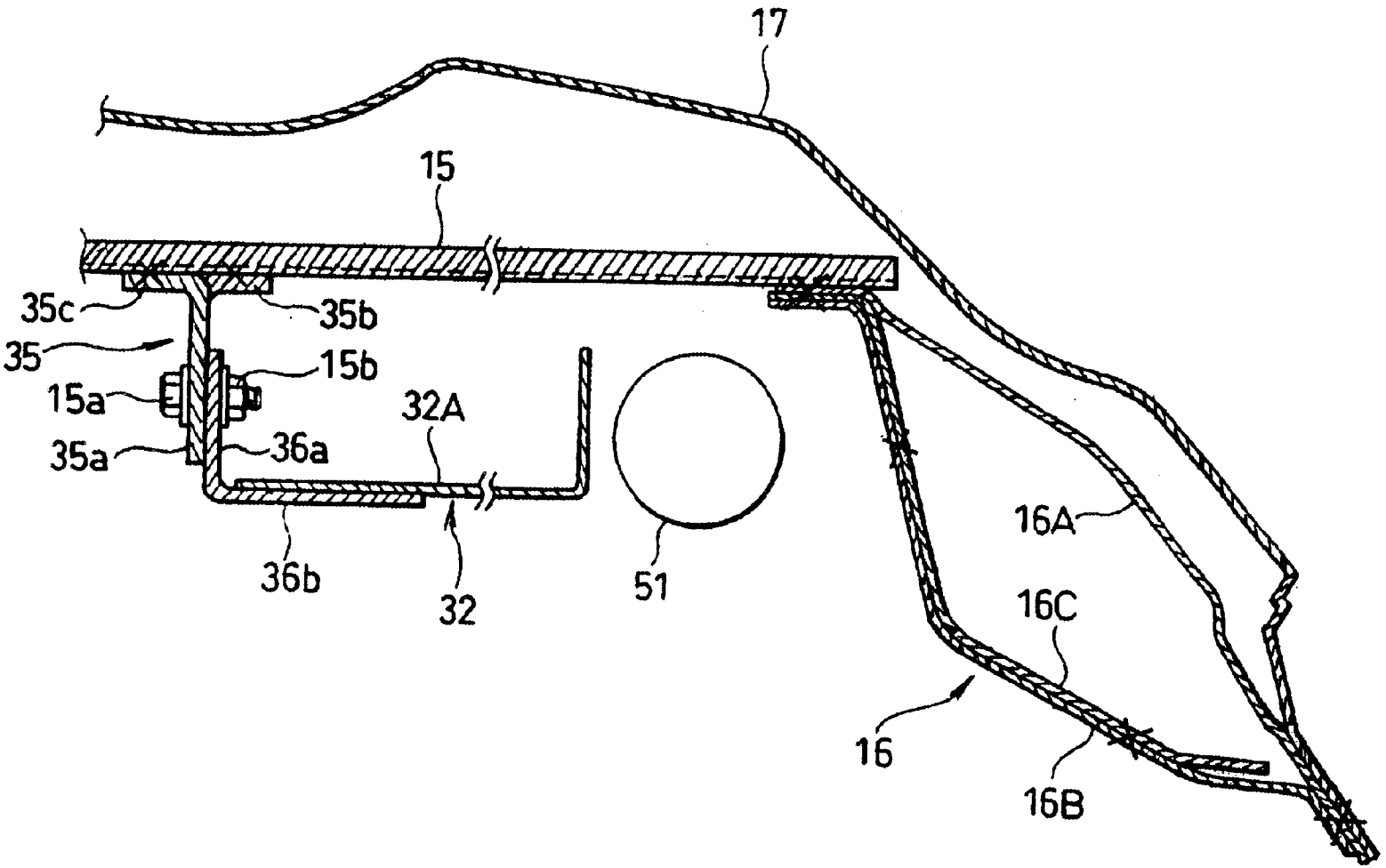
FIG. 6 is a sectional view taken along a line VI—VI of FIG. 2.

The mounting base 32 is connected at the middle section thereof with the brace 15 through a first inner bracket 35 and a second inner bracket 36, respectively. The brace 15 is, as shown in FIG. 6, a belt like reinforcement member provided under the roof panel 17 across left and right side rails 16 (in the drawing, only left side is shown). The side rail 16 has a hollow cross section extending in the longitudinal direction of the vehicle and formed by L-shaped or C-shaped outer side rail 16A and inner side rail 16B reinforced by a reinforcement 16*c*.

The first inner bracket 35, as shown in FIGS. 4 and 6, has plate-like configuration and mounting surfaces 35*b*, 35*c* are bent at the upper end of a connecting surface 35*a* of the first inner bracket 35 and project in the outer and inner directions, respectively so as to form a T-shaped cross section. These mounting surfaces 35*b* and 35*c* are connected to the under surface of the brace 15 by welding.

On the other hand, as shown in FIG. 4, the second inner bracket 36 having a L-shaped cross section includes a connecting surface 36*a* and a mounting surface 36*b*. The mounting surface 36*b* is connected with the base plate 32A of the mounting base 32. By connecting the connecting surface 36*a* with the connecting surface 35*a* of the first inner bracket 35 by means of bolts 15*a* and nuts 15*b*, the mounting base 32 can be detachably connected with the brace 15.

Describing the front portion of the mounting base 32, the mounting base 32 is connected with the side rail 16 through an outer bracket 37. The outer bracket 37 is connected at the rear edge thereof with the front edge of the base plate 32A of the mounting base 32 and at the same time its outer edge extends in the forward direction along the side rail. Further, the outer bracket 37 forms a triangular configuration with a base lying along the front edge of the base plate 32A and has a reinforcement flange 37*b* bent upward along the oblique side of the triangle and a mounting flange 37*c* bent downward along the other base of the triangle.

Figure 7:
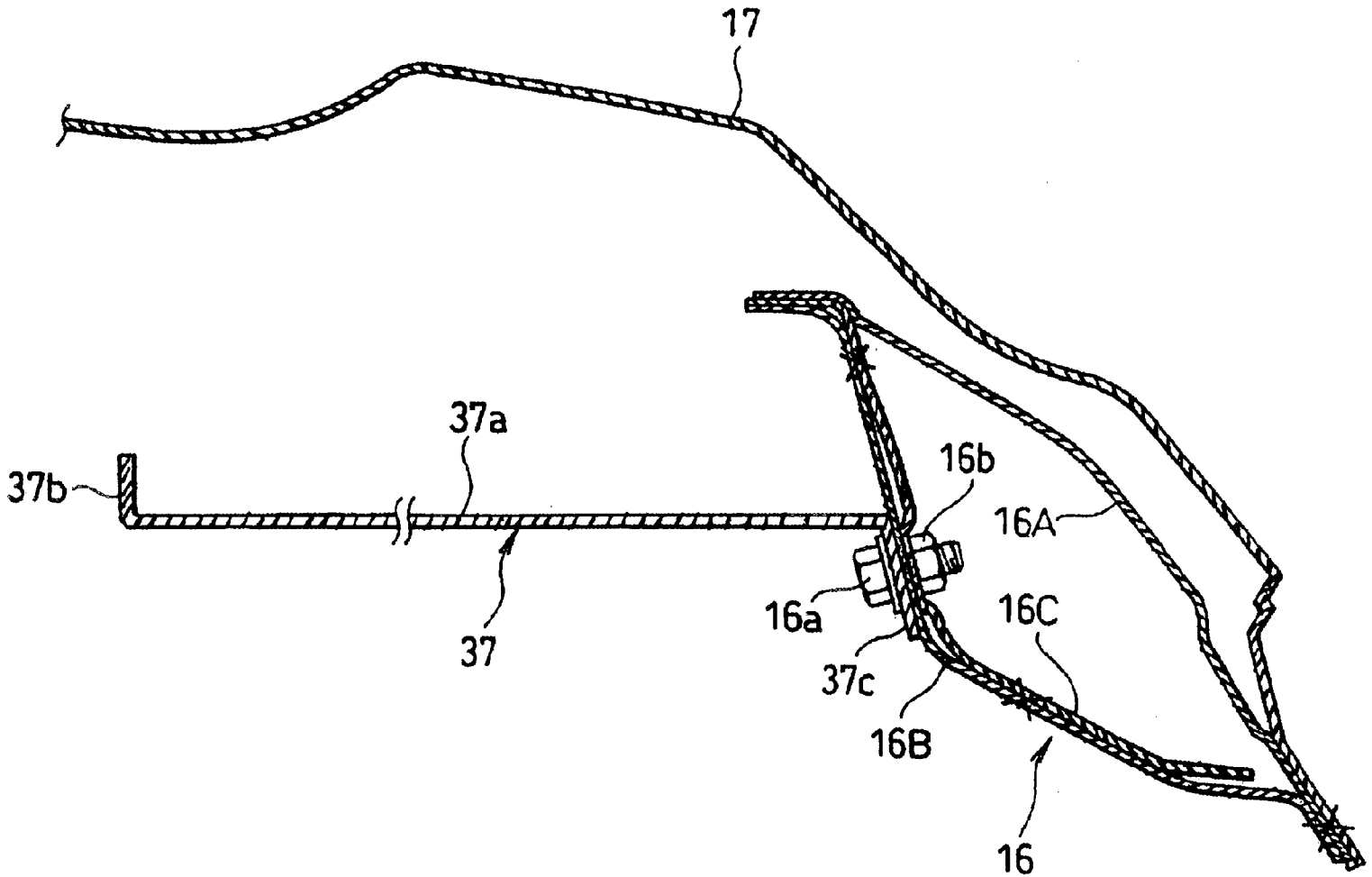
FIG. 7 is a sectional view taken along a line VII—VII of FIG. 2.

The connecting section of the mounting base 32 and the side rail 16 is shown in FIG. 7. The mounting flange 37*c* of the outer bracket 37 is connected by a bolt 16*a* and a nut 16*b* with an inner side rail 16B of the side rail 16. That is, the front portion of the mounting base 32 is detachably connected with the side rail 16. Thus, an accommodation space for the power module unit 40 is formed at the corner enclosed by the rear rail 14 and the side rail 16 under the roof.

A gas stay apparatus 50 is disposed between the mounting base 32 and the side rail 16 at almost the same height as and approximately in parallel with the connecting rod 46 and has a gas spring 51 jointing the side rail 16 and the hinge arm 23.

The gas spring 51 is rotatably connected at one end thereof with a bracket 53 secured to the side rail 16 through a ball joint 54 and is also rotatably connected with at the other end thereof, that is, an end of a position rod 51*a*, with the gas stay connection section 27 of the hinge arm 23 through a ball joint 55.

Accordingly, when a switch provided on an instrument panel is turned on to open the rear gate 20, the slider 45 is driven by the motor 41 to travel backward. Then, the connecting rod connection section 26 of the hinge arm 23 is pushed backward through the connecting rod 46 and the hinge arm 23 rotates about the pivot 22 together with the rear gate 20. As a result, the end of the piston rod 51*a* of the gas spring 51 rotates about the pivot 22 to draw a circle. The piston rod 51*a* is biased in the projecting direction by the pressure of sealed gas.

When the rear gate 20 is fully closed, the downward force due to the weight of the rear gate 20 is designed so as to be larger than the force pushing the rear gate 20 upward due to the biasing force of the gas spring 51.

Figure 10:
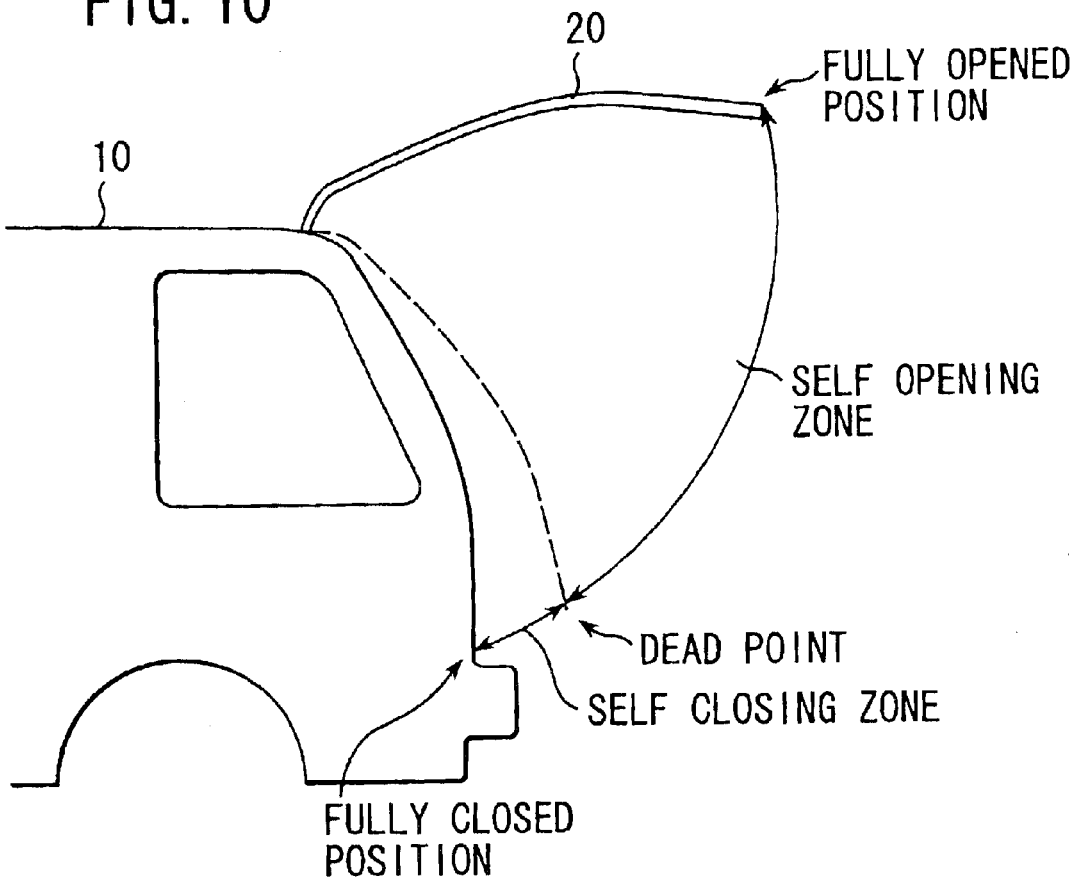
FIG. 10 is an explanatory view showing a control strategy of a rear gate opening and closing apparatus.
Figure 11:
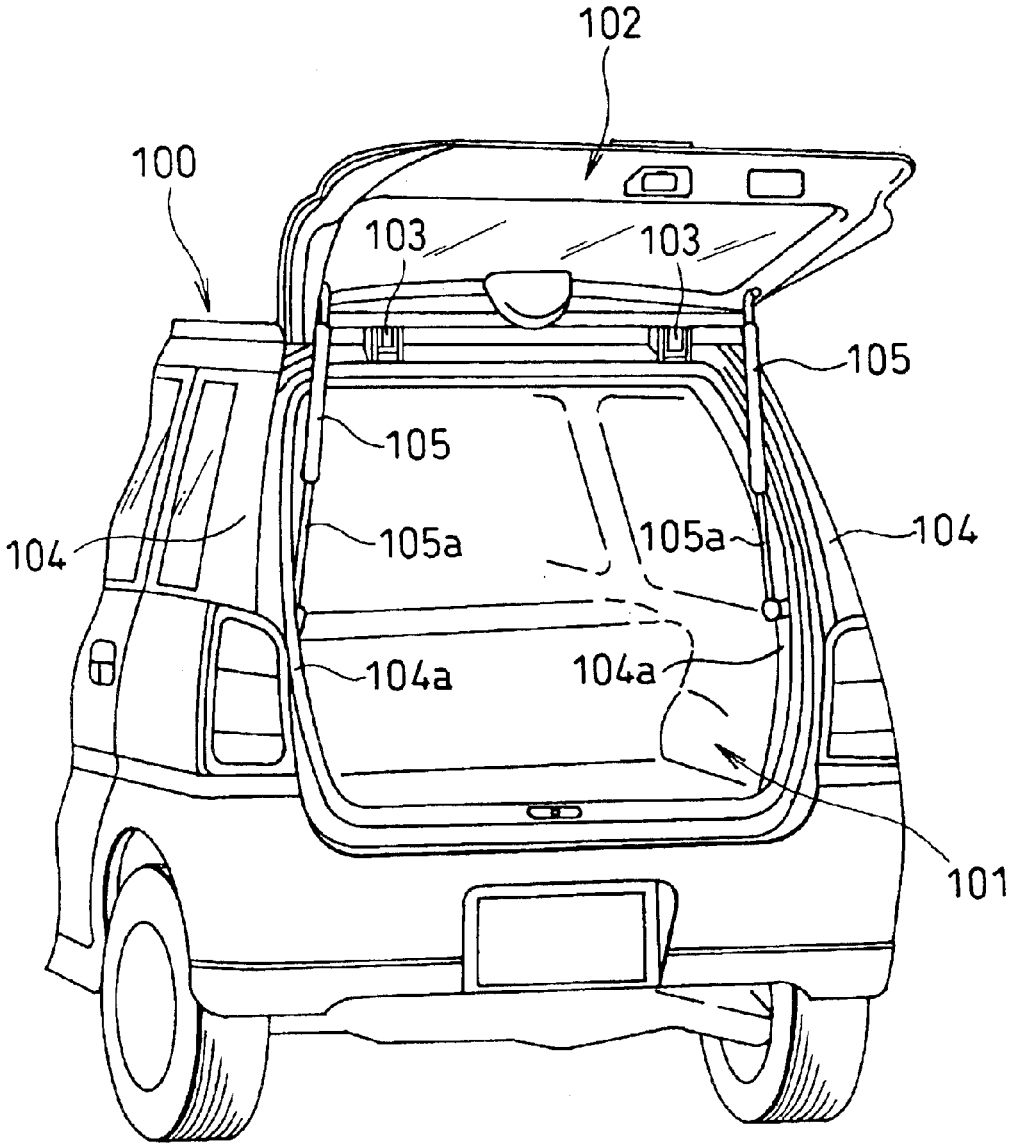
FIG.11 PRIOR ART
FIG. 11 is a perspective rear view of a vehicle having a rear gate structure according to a prior art.
Figure 12:
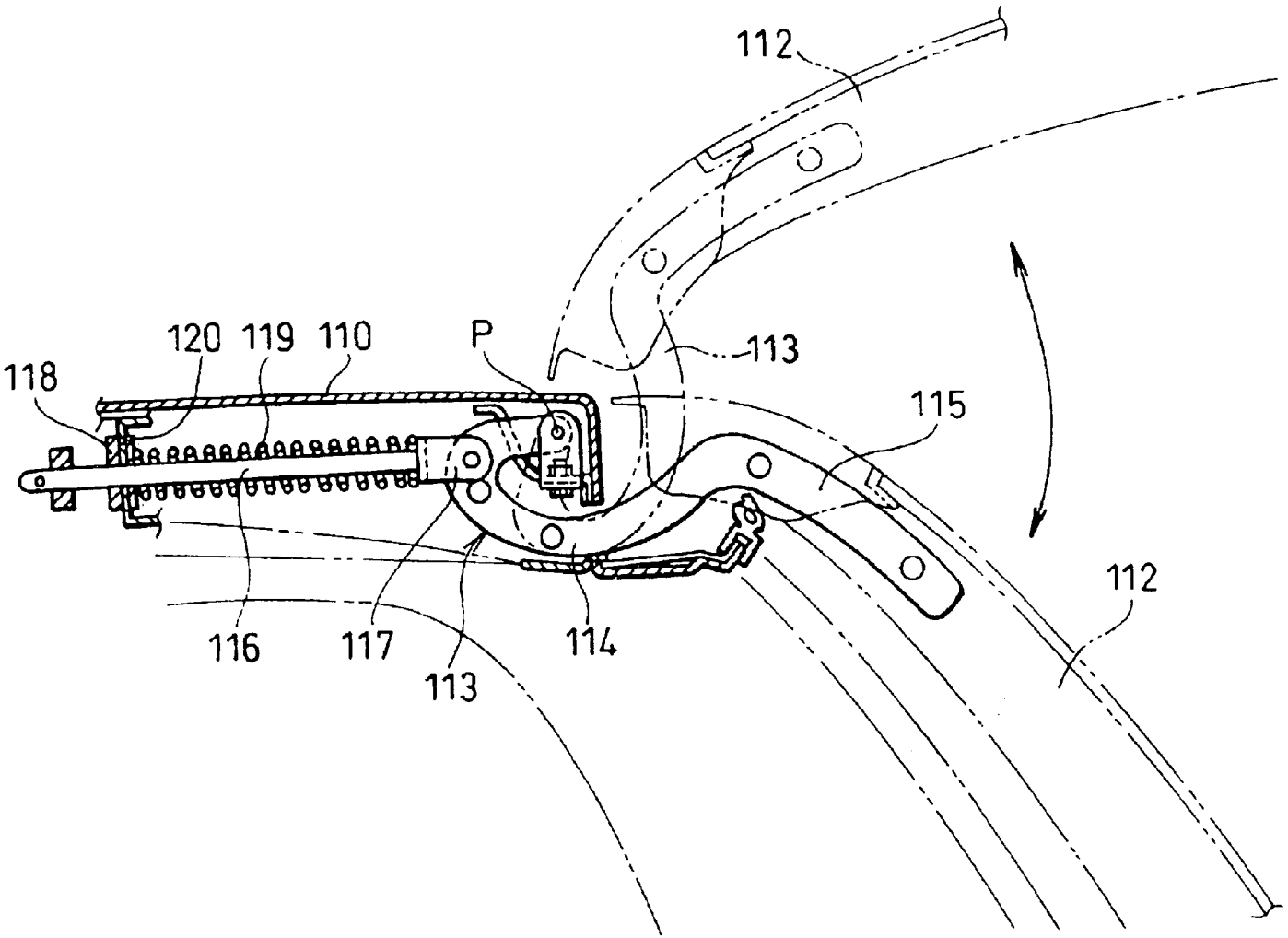
FIG. 12 PRIOR ART
FIG. 12 is a side view showing a rear gate structure according to a prior art.

Further, as shown in FIG. 10, when the rear gate 20 starts to open from the fully closing position, a dead point where the weight of the rear gate 20 balances with the biasing force of the gas spring 51 is found. A self closing zone where the weight of the rear gate 20 is larger than the biasing force of the gas spring 51 and the rear gate closes without any operating force applied is formed between the fully closing position and the dead point. On the other hand, a self opening zone where the biasing force of the gas spring 51 is larger than the weight of the rear gate 20 is formed between the dead point and the fully opening position.

Accordingly, since the power unit module 40 and the slider 45 which have relatively large weight and are subjected to the reaction force from the rear gate 20, is mounted on the mounting base 32 and the mounting base 32 is secured to the steady roof members such as the rear rail 14, the brace 15, the side rail and the like, the power unit module 40, the slider 45, the connecting rod 46 interlocking the slider 45 and the hinge arm 23 can be supported in a stable condition.

Further, since the mounting base 32 is detachably connected with the rear rail 14, the brace 15 and the side rail 16 by the bolts and nuts, it is possible first to attach the power unit module 40, the slider 45 and the like to the mounting base 32 and then to mount this subassembly to the rear rail 14, the brace 15 and the side rail 16, thereby the installation work of the rear gate opening and closing apparatus 30 is simplified. As a result, the productivity at the production stage or the workability at the repairing stage is can be enhanced.

Further, since the gas spring 51 is longitudinally disposed at approximately the same height as and in parallel with the connecting rod 46, the opening and closing apparatus 30 comprising the drive unit 31 and the gas stay apparatus 50 can be formed compactly within a limited vertical space. Further, since the opening and closing apparatus 30 is efficiently accommodated in a space enclosed by the rear rail 14, the side rail 16 and the roof, the passenger compartment space can be utilized effectively.

Further, since the gas spring 51 is not disposed between the side edge 13*a* and the rear gate 20, the rear pillar, the rear gate 20 and the like can be freely styled and designed.

Figure 8:
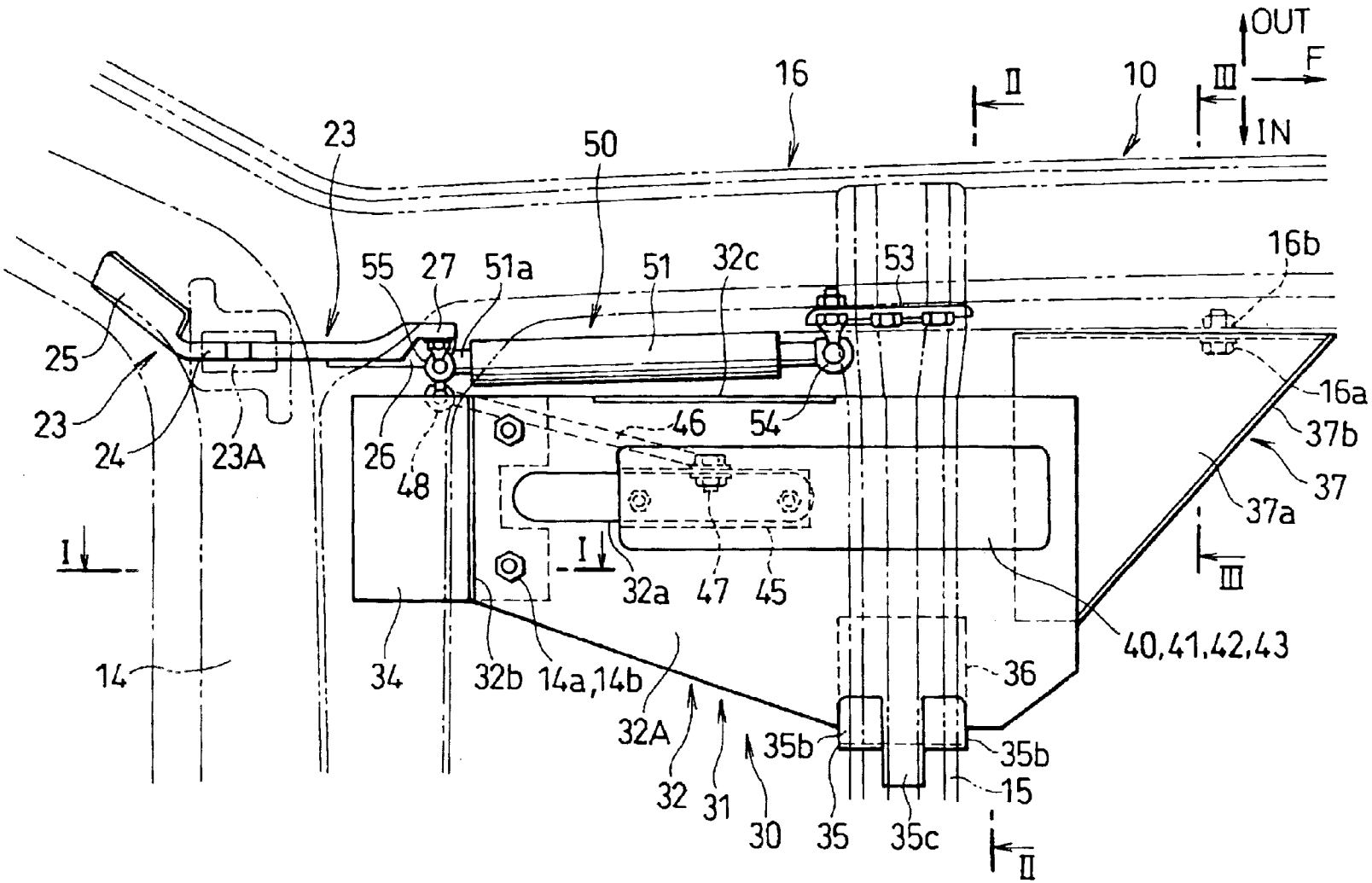
FIG. 8 is a plan view showing a drive unit of a rear gate opening and closing mechanism according to a second embodiment of the present invention.

FIG. 8 shows a rear gate opening and closing mechanism according to a second embodiment. The power unit module 40 includes the motor 41 described before, a clutch 42 and an encoder 43. Further, an electronic control unit (hereinafter, referred to as ECU) 60 is disposed in the vehicle and makes an automatic opening and closing control of the rear gate 20.

The clutch 42 connects the motor 41 with the slider 45 when it is energized and the connection is released when it is deenergized. When an operator wants to open or close the rear gate 20 manually, a handle switch 62 which will be described hereinafter is operated and the ECU 60 detects this to deenergize the clutch 42. When the clutch is deenergized, the motor 41 is disengaged with the slider 45 and the rear gate 20 can be operated to open or close manually. On the other hand, when the operator wants to open or close the rear gate 20 automatically, the clutch 42 is energized to engage the motor 41 with the slider 45. As a result, the rear gate can be opened or closed automatically.

The encoder 43 provided in the power unit module 40 detects the position of the slider 45 and outputs the positional signal to the ECU 60.

Figure 9:
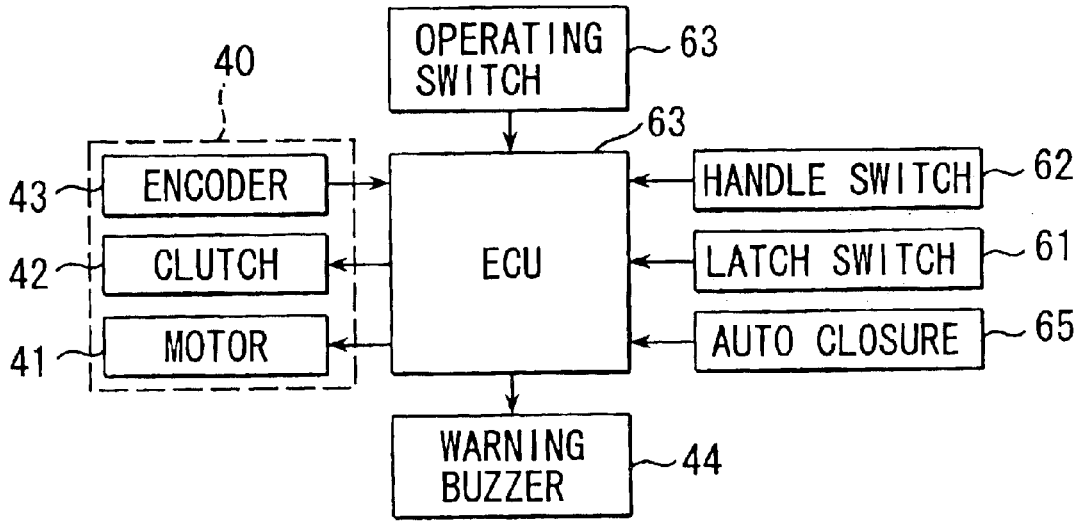
FIG. 9 is a block diagram of a control apparatus of a rear gate opening and closing apparatus according to a second embodiment of the present invention.

As shown in FIG. 9, the ECU 60 is connected with a warning buzzer 44, a latch switch 61, a handle switch 62, an operating switch 63 and an auto closure 65. The operating switch 63 is provided with an opening switch (not shown), a closing switch (not shown) and a stop switch (not shown). When an operator operates these switches, an opening signal, a closing signal and a stop signal are outputted to the ECU 60, respectively. The handle switch 62 provided in an outer handle (not shown) for operating the rear gate 20 manually, is for detecting the operating condition of the outer handle.

The auto closure switch 65 is for holding or releasing a striker provided at the lower end of the rear gate 20 by actuating an electrically operated latch thereof.

The latch switch 61 acts as detecting whether or not the striker exists in a guide groove of the auto closure 65. When the latch switch 61 detects the striker, the latch rotates to engage the striker in an engaging groove of the latch.

The warning buzzer 44 raises warnings intermittently when the rear gate 20 is in an automatic opening or closing mode. The interval of intermittent warning is established so as to change according to the opening mode or closing mode.

Accordingly, the operator can recognize whether the rear gate 20 is opening or closing without seeing the movement of the rear gate. Further, the buzzer can warn surrounding persons of the moving rear gate 20. The warning buzzer 44 may be accompanied by a hazard lamp and the like.

Signals from the operating switch 63, encoder 43, handle switch 62 and latch switch 61 are inputted to the ECU 60 and the clutch 42, motor 41 and auto closure 65 are controlled by the output from the ECU 60 to automatically open or close the rear gate 20.

Hereinafter, the automatic opening and closing operation will be described. First, in case where the rear gate 20 is fully closed, when the opening switch of the operating switch 63 is operated, the latch of the auto closure 65 rotates in the opening direction to release the striker from the hold position.

When the striker is released, the rear gate 20 is pushed in the opening direction by the reaction force of weather strips and the like and the striker comes out of the guide groove. At this moment, the latch switch 61 detects the release of the striker.

Then, the ECU 60 receives a release signal from the latch switch 61 and energizes the clutch 42 to connect the motor 41 with the slider 45. At the same time, the ECU 60 energizes the motor 41 and the motor 41 rotates in the forward (opening) direction.

When the motor 41 rotates in the forward direction, the slider 45 travels in the opening direction of the rear gate 20, that is, in the backward direction, through the gear box. When the slider 45 travels in such a way, the rear gate 20 rotates in the opening direction through the connecting rod 46 and hinge arm 23. The ECU 60 detects a position where the rear gate is based on signals from the encoder 43 and controls the driving force of the motor 41 according to the position of the rear gate 20.

For example, as shown in FIG. 10, when the rear gate 20 is in the self closing zone as described before, the driving force of the motor 41 is controlled so as to assist the biasing force of the gas spring 51 in the opening direction of the rear gate 20. On the other hand, when the rear gate 20 in the self opening zone, the driving force of the motor 41 is controlled so as to restrict the movement of the rear gate 20 in the opening direction.

Thus, when the rear gate 20 is in the self closing zone, the biasing force of the gas spring 51 is reduced and, when in the self opening zone, the rear gate 20 is prevented from rotating in the opening direction at a speed higher than a specified speed. Particularly, since the biasing force of the gas spring 51 tends to become large in accordance with an increase of outside temperature and as a result the opening speed of the rear gate 20 tends to become high, the opening speed can be controlled to be constant.

When the encoder 43 detects the rear gate 20 fully opened, the opening motion is finished. In case where the output of the encoder 43 does not change in spite of driving the motor 41, it is judged that the rotation of the rear gate 20 in the opening direction is inhibited by an obstacle and the like, and the opening motion is stopped.

Further, when an operator operates the outer handle to stop the opening motion and an input signal is received from the handle switch 62, the opening motion stops. In order to stop the opening motion, the motor 41 stops its rotation. The operating switch 63, according to the input from the operating switch 63 or the handle switch 62, selects condition of continuing the opening operation, condition of continuing the closing operation and condition of enabling the manual operation.

The above control is initialized when the rear gate 20 is closed by the manual or automatic operation and comes into a fully closing condition. The ECU 60 sets the position of the rear gate to the fully closing position based on the detection signal of the latch switch 61.

Accordingly, in case where the rear gate 20 stops its motion on the way of opening or closing and as a result the encoder is unable to detects the current position of the rear gate 20, the position of the rear gate 20 can be initialized by once manually bringing the rear gate 20 into the fully closing condition.

On the other hand, in case where the rear gate 20 is in a fully opening condition, when the closing switch of the operating switch 63 is operated, the ECU 60 energizes the clutch 42 to engage the motor 41 with the slider 45 and the motor 41 is driven in the closing direction.

When the motor 41 is driven in the closing direction, the slider 45 travels in the direction of closing the rear gate 20, that is, in the forward direction through the gear box, and rotates the rear gate 20 in the closing direction through the connecting rod 46 and the hinge arm 23. The ECU 60 detects the position of the rear gate 20 based on a detection signal of the encoder 43 and controls the driving force of the motor 41 according to the position of the rear gate.

For example, when the rear gate 20 is in the self opening zone, the rear gate 20 is controlled against the biasing force of the gas spring 51 so as to rotate in the closing direction and when the rear gate 20 is in the self closing zone, the rear gate 20 is controlled so as to restrict the rotation in the closing direction. Through this control, the rear gate 20 can be prevented from rotating in the closing direction at a speed higher than established beforehand.

When the rear gate 20 rotates in the closing direction and the entrance of the striker into the guide groove is detected, the clutch 42 is deenergized and the engagement of the clutch 42 is released. At the same time, the latch is rotated by the auto closure 65 and the striker is engaged with the engagement groove of the latch, thereby the rear gate 20 comes in a fully closing condition.

Thus, a series of the opening and closing motion through the operating switch 63 finishes. With respect to the stop of closing operation due to an obstacle or by the operation of the outer handle and the initialization of the control, since these are the same as the above described controls from the fully closing condition to the fully opened condition, descriptions in more detail will be omitted.

Next, the automatic opening and closing motion by other operations than the operating switch 63 will be described.

For example, in case where the rear gate 20 is in a fully closing condition, an operator operates the outer handle to release the engagement between the latch and the striker. As a result, the rear gate can be opened manually.

The ECU 60 calculates the rotation speed in the opening direction of the rear gate 20 based on a detection signal of the encoder 43 and judges whether or not the speed is within an established speed range. When it is within a specified speed range, the motor 41 is controlled to rotate at a speed corresponding to the specified opening speed and then the clutch 42 is engaged. As a result, the rear gate 20 rotates automatically in the opening direction. On the other hand, when it is not within a specified speed range, the automatic opening motion of the rear gate 20 stops.

Further, in case where the rear gate 20 is fully opened, when the operator rotates the rear gate 20 by hand in the closing direction, the ECU 60 calculates the traveling speed in the closing direction of the rear gate 20 based on a detection signal from the encoder 43. Further, the ECU 60 judges whether or not the traveling speed is within a specified speed range. If it is within a specified speed, the motor 41 rotates in the closing direction at a speed corresponding to the traveling speed and the clutch 42 is engaged. The rear gate 20 rotates in the closing direction automatically. If it is not within a specified speed, the automatic closing motion stops.

Thus, since the rear gate 20 can be opened or closed without using the operating switch 63, it is convenient and easy to use, for example, baggage can be carried into or out of the compartment easily.

The present invention is not limited to the embodiment described above. For example, according to the embodiment of the present invention, the encoder 43 serves as detecting the fully opening or closing position of the rear gate 20 or the encounter of an obstacle during traveling of the rear gate, however alternatively, an electric current passing through the motor 41 may be used.

That is, the fully opening or closing position or an obstacle during opening and closing operation may be detected based on an increase or decrease of electric current passing through an ampere detection circuit according to the load of the motor.

According to a rear gate automatic opening and closing apparatus for a vehicle disclosed in the second embodiment, the clutch and actuator is controlled based on the operation of the operating means to automatically open or close the rear gate. At this moment, the traveling speed of the rear gate is calculated based on a detection signal of the encoder and the actuator is controlled so as to open or close at a specified speed.

Accordingly, the traveling speed of the rear gate can be controlled properly. Particularly, the rear gate opening speed tends to increase due to an increase of the biasing force according to outside temperature rise and the control means according to the present invention enables the rear gate to open irrespective of outside temperature at a constant speed.

Further, since the clutch is provided between the actuator and the rear gate, by disengaging the clutch the rear gate can be operated to open or close by hand.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A vehicle having an opening and closing apparatus for automatically opening and closing a rear gate of said vehicle, said apparatus comprising:

a power source unit that produces power to actuate said rear gate;

a slider that transforms said power into a reciprocating motion in the longitudinal direction of said vehicle;

a hinge arm attached at an upper end of said rear gate so that said rear gate is pivotally connected with a body of said vehicle;

a connecting rod that interlocks said slider and said hinge arm, said rod transmitting said reciprocating motion to said hinge arm;

a mounting base that supports said power source unit and said slider;

said mounting base attached to said vehicle in a space formed by a rear rail, a side rail and an under roof of said vehicle; and a gas stay, rotatably mounted on said side rail at one end thereof and mounted on said hinge arm at the other end thereof, disposed at substantially the same height as and approximately in parallel with said connecting rod and as said rear gate moves between a fully open position and a closed position, said gas stay extends in the longitudinal direction of the vehicle generally parallel with said roof for biasing said rear gate in an opening direction.

2. The vehicle according to claim 1, wherein said mounting base is partly installable on a brace extending in the transverse direction of said vehicle.

3. The vehicle according to claim 1, wherein said apparatus further comprises:

a clutch for disconnecting said power source unit with said slider so as to enable an operator to open or close said rear gate by hand.

4. The vehicle according to claim 1, wherein said apparatus further comprises:

a position detector for detecting a position of said rear gate and for outputting a detection signal thereof; and a controller for controlling said power source unit for actuating said rear gate so as to automatically open and close said rear gate based on the detection signal from said position detector.

5. The vehicle according to claim 4, wherein said controller controls said power source unit for actuating said rear gate so as to control an opening and closing speed of said rear gate based on the detection signal from said position detector.

6. The vehicle according to claim 4, wherein said controller controls said power source unit for actuating said rear gate so as to vary an opening speed of the rear gate so that a rotation of said rear gate in an opening direction is assisted when said rear gate is in a self closing zone and the rotation in the opening direction is restricted when said rear gate is in a self opening zone.

7. The vehicle according to claim 4, wherein said controller controls said power source unit for actuating said rear gate so as to vary a closing speed of the rear gate so that a rotation of the rear gate in a closing direction is assisted when said rear gate is in a self-opening zone and said rotation of said rear gate in the closing direction is restricted when said rear gate is in a self-closing zone.

8. The vehicle according to claim 4, wherein said controller judges, based on said detection signal from said position detector, when said rear gate had reached said fully opened condition of said rear gate when said rear gate, while performing an opening operation, is arrived at a predetermined position.

9. The vehicle according to claim 4, wherein said controller judges, based on a load of said power source unit, a fully opened or closed condition of said rear gate.

10. The vehicle according to claim 4, wherein said apparatus has a warning means for raising an alarm during the opening and closing motion of said rear gate.

11. The vehicle according to claim 4, wherein said controller judges whether or not the opening and closing motion of said rear gate is performed automatically based on a speed of said rear gate at which said rear gate is manually operated, when the speed of said rear gate, at which said rear gate is manually operated, is within a specified speed range, said controller judges that the opening and closing operation is performed automatically.

12. The vehicle according to claim 4, wherein said apparatus further comprises:

a clutch for disconnecting said power source unit with said slider so as to enable an operator to open or close said rear gate by hand, wherein said apparatus has a handle switch for manually opening and closing said rear gate and said controller stops an automatic operation of said rear gate based on a detection signal of said handle switch and disengages said clutch.

13. The vehicle according to claim 4, wherein said apparatus has a latch switch for detecting a fully closed condition of said rear gate and for outputting a detection signal and said control means initializes said position of said rear gate.

14. The vehicle according to claim 4, wherein said controller judges, based on said detection signal from said position detector, a fully closed condition of said rear gate when said rear gate, while performing a closing operation, is arrived at a predetermined position.

* * * * *